US006272987B1

(12) United States Patent
Kamoda

(10) Patent No.: US 6,272,987 B1
(45) **Date of Patent: *Aug. 14, 2001**

(54) INTAGLIO PRINTING PRESS

(75) Inventor: Hiroyoshi Kamoda, Chiba (JP)

(73) Assignee: Komori Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/376,010

(22) Filed: Aug. 18, 1999

(30) Foreign Application Priority Data

Aug. 21, 1998 (JP) ..... 10-235101
Jul. 2, 1999 (JP) ..... 11-188509

(51) Int. Cl.[7] ..... B41F 9/00

(52) U.S. Cl. ..... 101/153; 101/152; 101/151; 101/150; 101/175; 101/177; 101/183

(58) Field of Search ..... 101/153, 150, 101/151, 152, 154, 155, 119, 120, 174, 175, 177, 183

(56) References Cited

U.S. PATENT DOCUMENTS 4,056,056 * 11/1977 Giori ..... 101/152
4,441,423 * 4/1984 Germann ..... 101/175
4,445,432 * 5/1984 Ford, Jr. et al. ..... 101/152
4,516,496 * 5/1985 Giori ..... 101/152
4,552,066 * 11/1985 Giori ..... 101/152
4,604,951 * 8/1986 Ichikawa et al. ..... 101/153
4,794,856 * 1/1989 Giori ..... 101/152
5,062,359 * 11/1991 Giori ..... 101/152
5,146,850 * 9/1992 Funada et al. ..... 101/153
5,224,420 * 7/1993 Schneider ..... 101/177 X
5,282,417 * 2/1994 Germann ..... 101/152
5,899,145 * 5/1999 Schaede ..... 101/152

FOREIGN PATENT DOCUMENTS 877000 5/1953 (DE) .
0406157A1 1/1991 (EP) .
0563007A1 9/1993 (EP) .
3038347A 2/1991 (JP) .

* cited by examiner

*Primary Examiner*—John S. Hilten
*Assistant Examiner*—Minh H. Chau

(57) ABSTRACT

An intaglio printing press comprises a plate cylinder capable of having three intaglio plates mounted along a circumferential direction of the plate cylinder; an ink collecting cylinder contacted with the plate cylinder and capable of having four blankets mounted along a circumferential direction of the ink collecting cylinder; five inking devices and five chablon rollers, disposed along the circumferential direction of the ink collecting cylinder, for supplying inks to the blankets of the ink collecting cylinder; a wiping roller contacted with the plate cylinder; and an impression cylinder having the same diameter as the diameter of the plate cylinder, and contacted with the plate cylinder. This intaglio printing press can perform printing in five or more colors.

12 Claims, 3 Drawing Sheets

INTAGLIO PRINTING PRESS

BACKGROUND OF THE INVENTION

1. Field of the Invention

The present invention relates to an intaglio printing press, and especially, one useful when applied to printing of banknotes or securities.

2. Description of the Related Art

FIG. 2 shows an example of a conventional intaglio printing press applied to printing of banknotes or securities (see, for example, Japanese Unexamined Patent Publication No. 3-38347). As shown in FIG. 2, a so-called triple-size impression cylinder 112 is contacted with a transfer cylinder 111 disposed on a feed side of a sheet feeder 110, the triple-size impression cylinder 112 having three grippers disposed with equal spacing along a circumferential direction of the impression cylinder 112 so that three rubber blankets can be mounted. To the impression cylinder 112, a so-called triple-size plate cylinder 113 is opposed in contact therewith which can have three intaglio plates mounted along a circumferential direction of the plate cylinder 113. To the plate cylinder 113, a so-called triple-size ink collecting cylinder 114 is opposed in contact therewith which can have three rubber blankets mounted along a circumferential direction of the ink collecting cylinder 114. To the ink collecting cylinder 114, four chablon rollers (so-called single cylinders) 115 are opposed in contact therewith along a circumferential direction thereof. Each of the chablon rollers 115 has a circumferential surface length corresponding to the length of the blanket of the impression cylinder 112, or the length of the intaglio plate of the plate cylinder 113. To these chablon rollers 115, inking devices 116 for supplying ink are opposed in contact therewith. In these inking devices 116, inks of different colors are filled. Opposite and in contact with the plate cylinder 113 and downstream from the ink collecting cylinder 114, a wiping roller 117 is disposed for removing surplus ink adhering to the surface of the intaglio plate. The wiping roller 117 is immersed in a solvent stored in a wiping tank 118. To the impression cylinder 112, a delivery cylinder 119 of a delivery device 120 is opposed in contact therewith.

The foregoing conventional intaglio printing press is operated in the following manner:

When ink is supplied from each inking device 116 to each chablon roller 115, the ink is fed from the chablon roller 115 to the intaglio plates of the plate cylinder 113 via the blankets of the ink collecting cylinder 114. Surplus ink that has adhered to the surface of the intaglio plate is removed by the wiping roller 117. When a sheet is received from the transfer cylinder 111 of the sheet feeder 110 to the impression cylinder 112, the ink on the intaglio plate of the plate cylinder 113 is transferred to the sheet to perform printing. The printed sheet is passed on to the delivery cylinder 119, and discharged by the delivery device 120.

An intaglio printing press for printing of banknotes or securities is strongly required to have a further multicolor printing function (for printing in five or more colors), from the point of view of forgery prevention or the like. With the above-described conventional intaglio printing press, however, only up to four of the chablon rollers 115 and four of the inking devices 116 can be disposed around the ink collecting cylinder 114 because of the structure of the printing press. Thus, printing in five or more colors has been impossible.

SUMMARY OF THE INVENTION

The present invention has been accomplished in view of the above-described problems. It is an object of the invention to provide an intaglio printing press capable of printing in five or more colors.

To attain the above object, the present invention claims an intaglio printing press, comprising:

a plate cylinder capable of having three intaglio plates mounted along a circumferential direction of the plate cylinder;

an ink collecting cylinder contacted with said plate cylinder and capable of having four blankets mounted along a circumferential direction of the ink collecting cylinder;

a wiping roller contacted with said plate cylinder; and an impression cylinder having the same diameter as the diameter of said plate cylinder, and contacted with said plate cylinder.

According to the intaglio printing press of the present invention, as noted above, the ink collecting cylinder is a so-called quadruple-size cylinder which can have four blankets mounted thereon. Thus, five or more ink supply means can be disposed around said ink collecting cylinder, so that printing in five or more colors can be performed.

In the intaglio printing press, a plurality of ink supply means for supplying inks to said blankets on said ink collecting cylinder may be disposed along the circumferential direction of said ink collecting cylinder. In the intaglio printing press, moreover, five or more of said ink supply means may be disposed.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

PREFERRED EMBODIMENTS OF THE INVENTION

An embodiment of an intaglio printing press according to the present invention will now be described with reference to FIG. 1, which shows a schematic constitution drawing thereof. However, it should be understood that the invention is not restricted to this embodiment.

Figure 1:
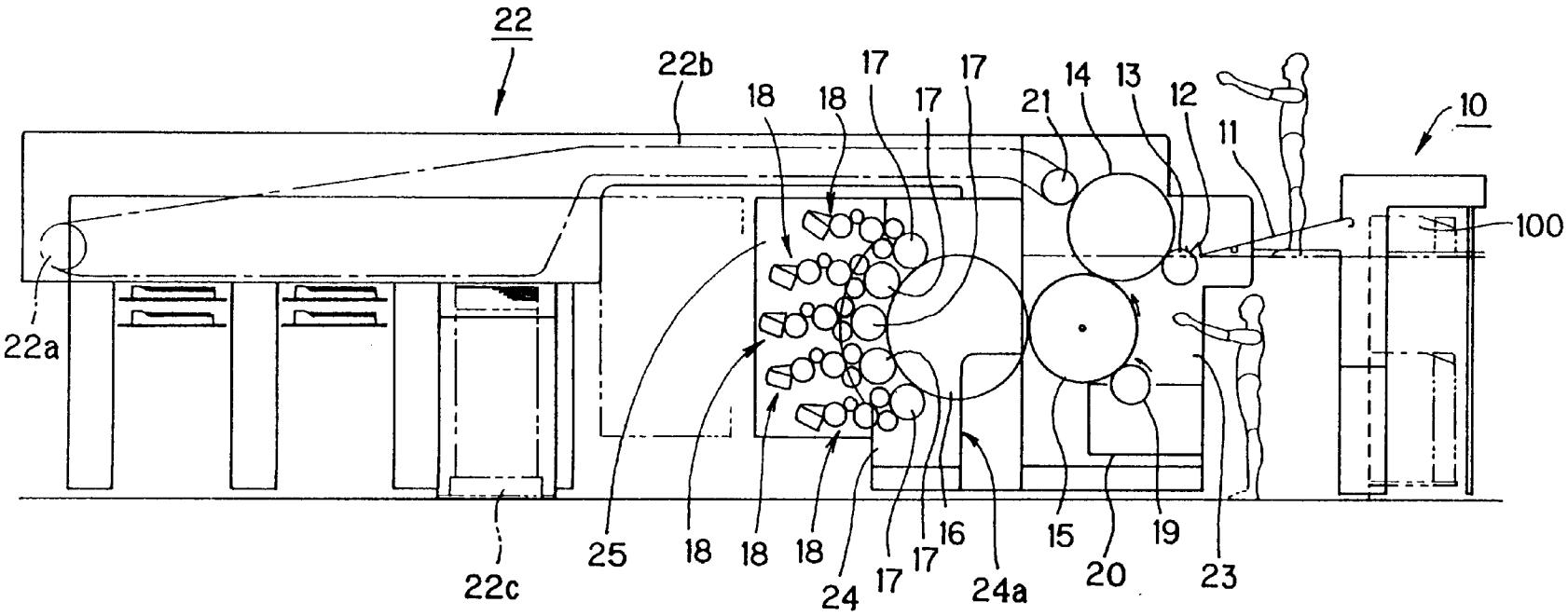
FIG. 1 is a schematic constitution drawing of an embodiment of an intaglio printing press according to the present invention.
Figure 2:
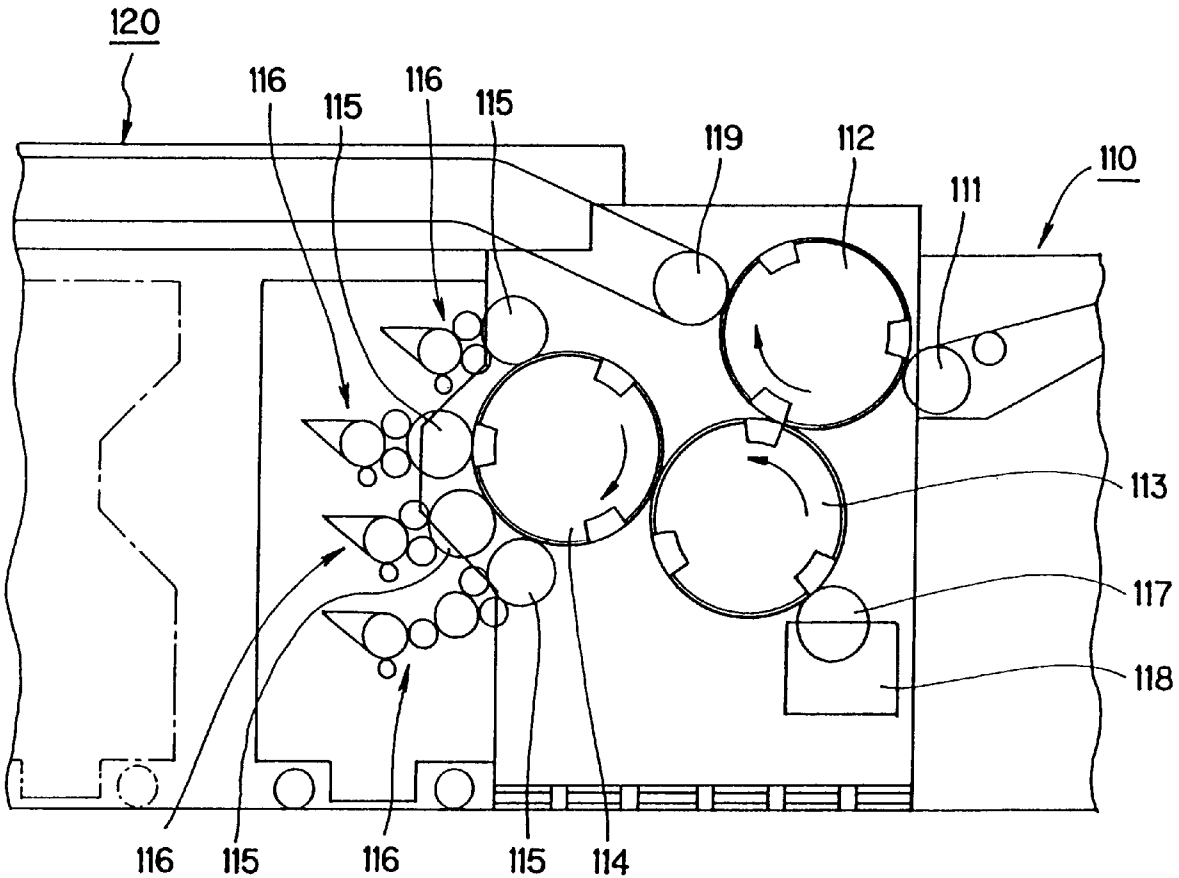
FIG. 2 Related Art
FIG. 2 is a schematic constitution drawing of an essential part of an example of a conventional intaglio printing press.
Figure 3:
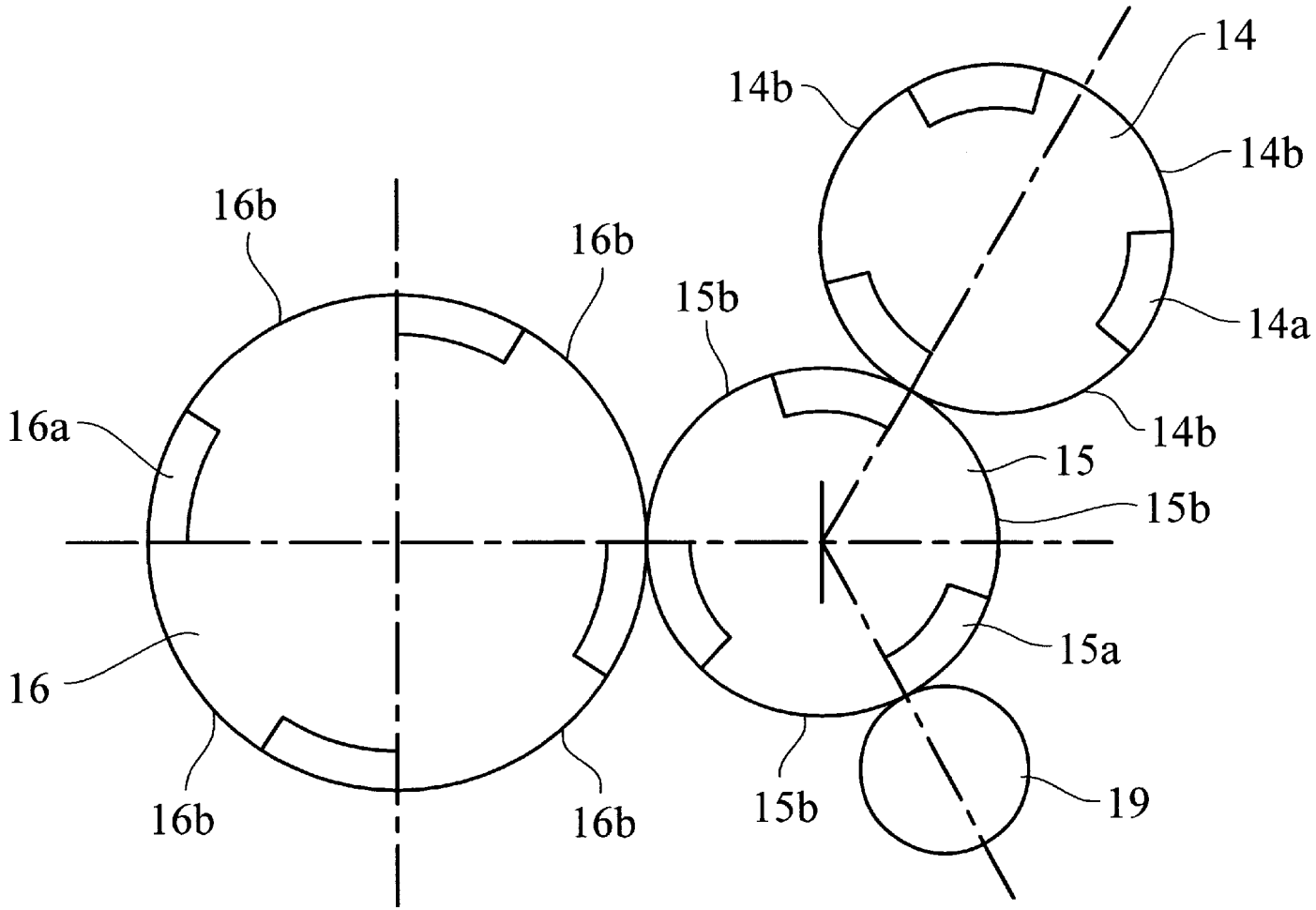
FIG. 3 is a diagram further illustrative of the relationship between the cylinders shown in FIG. 1.

As shown in FIG. 1, a sheet feeder 10 stacked with sheets 100 communicates with a feedboard 11, which receives the sheets 100 fed one by one from an upper layer of a sheet stack by a sucker mechanism of the sheet feeder 10, and performs registration for printing. On the feedboard 11, a swing arm shaft pregripper 12 is disposed for gripping the sheet 100 on the feedboard 11 and making a swing motion. The swing arm shaft pregripper 12 communicates, via a transfer cylinder 13, with a so-called triple-size impression cylinder 14, which has three grippers disposed with equal spacing along a circumferential direction of the impression cylinder 14 so that three rubber blankets can be mounted thereon. The impression cylinder 14 is supported by a frame 23. The transfer cylinder 13 is provided with grippers similar to the grippers of the impression cylinder 14, so that the sheet 100 from the swing arm shaft pregripper 12 can be passed on to the gripper of the impression cylinder 14.

To the impression cylinder 14, a so-called triple-size plate cylinder 15, which can have three intaglio plates mounted along a circumferential direction of the plate cylinder 15, is opposed in contact with the impression cylinder 14. The plate cylinder 15 is supported by the frame 23. To the plate cylinder 15, a so-called quadruple-size ink collecting cylinder 16, which can have four rubber blankets mounted along a circumferential direction thereof, is opposed in contact with the plate cylinder 15. The ink collecting cylinder 16 is supported by a frame 24. To the ink collecting cylinder 16, five chablon rollers (so-called single cylinders) 17 are opposed in contact with, and circumferentially of, the ink collecting cylinder 16, each chablon roller having a circumferential surface length corresponding to the length of the blanket of the impression cylinder 14, or the length of the intaglio plate of the plate cylinder 15. The chablon rollers 17 are each supported by the frame 24. These chablon rollers 17 are contacted with inking devices 18 for supplying ink. These inking devices 18 are each supported by a frame 25. Within the inking devices 18, inks of different colors are filled.

In short, the ink collecting cylinder 16 is constructed as the quadruple-size cylinder, around which five of the chablon rollers 17 and five of the inking devices 18 are disposed. Furthermore, the ink collecting cylinder 16 and the chablon rollers 17 are supported by the independent frame 24 so that the ink collecting cylinder 16 of a large size can be sufficiently supported. If the ink collecting cylinder 16 is a triple-size cylinder, only four of the chablon rollers 17 and four of the inking devices 18 can be disposed around the ink collecting cylinder 16. If the cylinder size of the ink collecting cylinder 16 is 5-fold or more, the entire machine becomes too large. Thus, the quadruple-size cylinder is appropriate.

If the plate cylinder 15 is of a double-size or smaller, it becomes difficult to install the wiping roller 19, etc. If its cylinder size is 4-fold or greater, the entire machine will be of too large a size. Thus, a triple-size cylinder is appropriate for the plate cylinder 15. If the impression cylinder 14 is different in cylinder size from the plate cylinder 15, misregister in printing may occur. Thus, the same cylinder size, namely, a triple-size cylinder is appropriate.

As shown in FIG. 1, the wiping roller 19 is contacted with the intaglio plate on the plate cylinder 15. The wiping roller 19 is immersed in a solvent stored in a wiping tank 20.

To the impression cylinder 14, a delivery cylinder 21 is opposed in contact therewith. On the delivery cylinder 21, a sprocket (not shown) of a delivery device 22 is provided coaxially. Between this sprocket of the delivery device 22 and a sprocket 22*a*, a pair of delivery chains 22*b* are looped. The delivery chains 22*b* are provided with delivery grippers (not shown). On a downstream side of the delivery chains 22*b* in a direction of their travel, a plurality of sheet receiving stands 22*c* are provided.

At a frame 23 side of the aforementioned frame 24, a window 24*a* is formed to permit an operator to enter and depart through the window 24*a*.

According to the present embodiment, an ink supply means is composed of the chablon roller 17, inking device 18, etc.

Three notches 14*a* are formed on the circumferential surface of the impression cylinder 14 at constant intervals (120° intervals) in the circumferential direction. Three notches 15*a* are formed on the circumferential surface of the plate cylinder 15 at constant intervals (120° intervals) in the circumferential direction between three intaglio plates 15*b*. Four notches 16*a*, however, are formed on the circumferential surface of the ink collection cylinder 16 at constant intervals (90° intervals) in the circumferential direction between four rubber blankets 16*b*. The respective notches 14*a*, 15*a*, and 16*a* of the impression cylinder 14, the plate cylinder 15, and the ink collection cylinder 16 have the same length in the circumferential direction, and the respective effective impression areas 14*b*, 15*b* and 16*b* of the impression cylinder 14, the plate cylinder 15, and the ink collection cylinder 16, located between the notches 14*a*, 15*a* and 16*a* also have the same length in the circumferential direction. The ink collection cylinder 16, the impression cylinder 14, and the wiping roller 19 are disposed around the plate cylinder 15 at constant intervals (120° intervals) in the circumferential direction, such that when one of the notches 15*a* of the plate cylinder 15 faces one of the notches 16*a* of the ink collection cylinder 16, one of the remaining notches 15*a* faces one of the notches 14*a* of the impression cylinder 14, and the other remaining notch 15*a* faces the wiping roller 19. Thus, the plate cylinder 15 and the ink collection cylinder 16 face each other through their notches 15*a*, 16*a*, and effective impression areas 15*b*, 16*b*, alternately. Further, when the cylinders 14, 15, and 16 rotate and the meeting point between the plate cylinder 15 and the impression cylinder 14 changes from between their effective impression areas 15*b* and 14*b* to between their notches 15*a* and 14*a*, the meeting point between the plate cylinder 15 and the ink collection cylinder 16 changes from between their effective impression areas 15*b* and 16*b* to between their notches 15*a* and 16*a*, and simultaneously, the meeting point of the wiping roller 19 relative to the plate cylinder 15 changes from the effective impression area 15*b* to the notch 15*a* of the plate cylinder 15. On the other hand, when the meeting point between the plate cylinder 15 and the impression cylinder 14 changes from between their notches 15*a* and 14*a* to between their effective impression areas 15*b* and 14*b*, the meeting point between the plate cylinder 15 and the ink collection cylinder 16 changes from between their notches 15*a* and 16*a* to between their effective impression areas 15*b* and 16*b*, and simultaneously, the meeting point of the wiping roller 19 relative to the plate cylinder 15 changes from the notch 15*a* to the effective impression area 15*b* of the plate cylinder 15.

The foregoing intaglio printing press is operated in the following manner: The sheets 100 are fed, one by one, from the sheet feeder 10 onto the feedboard 11. The sheet 100 is passed from the swing arm shaft pregripper 12 to the transfer cylinder 13, and then to the gripper of the impression cylinder 14, whereupon the sheet 100 is further transported. Separately, ink of each inking device 18 is transferred onto the ink collecting cylinder 16 via the chablon roller 17, and supplied onto the surface of the intaglio plate on the plate cylinder 15. Surplus ink is removed by the wiping roller 19. The sheet 100 is passed between the impression cylinder 14 and the plate cylinder 15, whereby the ink is transferred onto the sheet 100 for printing. The printed sheet 100 is carried by the delivery chains 22*b* of the delivery device 22 via the delivery cylinder 21, and discharged onto the sheet receiving stand 22*c*.

Since the ink collection cylinder 16, the impression cylinder 14, and the wiping roller 19 contact with the plate cylinder 15 under high pressure, a large shock is produced when the meeting point changes from between effective impression areas 14*b*, 15*b*, and 16*b* to between notches 14*a*, 15*a*, and 16*a* and from between the notches to between the aforementioned effective impression areas. For example, when a sheet is printed between the plate cylinder 15 and the impression cylinder 14 (when the effective impression areas 15*b* and 14*b* of the plate cylinder 15 and the impression cylinder 14 face each other), the above-described shock is produced between the plate cylinder 15 and the ink collection roller 16 and between the plate cylinder 15 and the wiping roller 19. In this case, the shock produced is transmitted to the contact area between the plate cylinder 15 and the impression cylinder 14, which can adversely affect the printing of the sheet, resulting in poor print quality. Further, if a shock is produced when the wiping roller 19 wipes off excessive ink from the plate cylinder 15, the shock may adversely affect the ink wiping-off operation, also resulting in poor print quality. Also, if a shock is produced when ink is transferred from the ink collection cylinder 16 to the plate cylinder 15, the shock can adversely affect the ink transfer, further resulting in poor print quality.

However, since the present invention employs the above-described configuration, the respective cylinders 14, 15, and 16 produce the above-described shocks simultaneously, the above-described problem does not occur, and print is thereby improved.

As described previously, the ink collecting cylinder 16 is constructed as a quadruple-size cylinder. Since five of the chablon rollers 17 and five of the inking devices 18 can be disposed around the ink collecting cylinder 16, five-color printing can be performed. The intaglio printing press with such a configuration can carry out printing in more colors than done by a conventional intaglio printing press.

Again, the reason for causing the respective cylinders 14, 16, and 19 in contact with the plate cylinder 15 to generate shocks concurrently at transition points between effective impression areas 14*b*, 16*b* and notches 14*a*, 15*a* is to prevent the shocks from affecting the printing or ink-wiping-off operation through prevention of generation of shocks during the printing of ink-wiping-off operation, or through international generation of shocks in periods in which the printing or ink-wiping-off operation is not performed. Thus, the above-described structure provides an action of canceling out shocks by causing shocks to be generated concurrently.

In addition to the constitution of the ink collecting cylinder 16 as a quadruple-size cylinder, the impression cylinder 14 and the plate cylinder 15 are supported by the frame 23, while the ink collecting cylinder 16 is supported by the frame 24. In other words, the impression cylinder 14 and plate cylinder 15, and the ink collecting cylinder 16 are supported by the independent frames 23 and 24, respectively. Hence, even at a site of high load imposed by the impression cylinder 14 and the plate cylinder 15, i.e., at a lower side of the frame 24 below the ink collecting cylinder 16, it becomes possible to form the window 24*a* through which the operator can get in and get out. Thus, maintenance work can be done easily.

Besides, five of the chablon cylinders 17 and five of the inking devices 18 are disposed in the present embodiment. If desired, six or more of each of them may be disposed.

This invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An intaglio printing press, comprising:

a triple size plate cylinder having three notches formed on a circumferential surface thereof at constant intervals in the circumferential direction, and further including three effective impression areas comprising three intaglio plates mounted along a circumferential surface between the three notches thereof;

a quadruple size ink collecting cylinder contacted with said plate cylinder and having four notches formed on a circumferential surface at constant intervals in the circumferential direction, four effective impression areas comprising blankets mounted between the four notches thereof;

a wiping roller contacted with said plate cylinder;

a triple size impression cylinder having a same triple size diameter as the diameter of said plate cylinder, contacted with said plate cylinder, and having three notches and three intermediate effective impression areas formed on the circumferential surface at constant intervals in the circumferential direction;

the respective notches of the impression cylinder, the plate cylinder, and the ink collection cylinder have the same length in the circumferential direction, and the respective effective impression areas of the impression cylinder, the plate cylinder, and the ink collection cylinder have the same length in the circumferential direction; and wherein the ink collection cylinder, the impression cylinder, and the wiping roller are disposed around the plate cylinder at constant intervals in the circumferential direction.

2. The intaglio printing press as claimed in claim 1, wherein a plurality of ink supply means for supplying inks to said blankets on said ink collecting cylinder are disposed along the circumferential outer surface of said ink collecting cylinder.

3. The intaglio printing press as claimed in claim 2, wherein five or more of said ink supply means are disposed.

4. The intaglio printing press as claimed in claim 2 and additionally including a first frame supporting said plate cylinder, said wiping roller and said impression cylinder, and a second frame adjacent and independent from said first frame supporting said ink collecting cylinder.

5. The intaglio printing press as claimed in claim 4 and additionally including a window in said second frame for permitting operator access to the interior thereof.

6. The intaglio printing press as claimed in claim 4 wherein each of said plurality of ink supply means is comprised of an inking device and a chablon roller, and additionally including a third frame supporting said plurality of inking devices and wherein said plurality of chablon rollers are supported by said second frame.

7. The intaglio printing press as claimed in claim 1 wherein said plate cylinder and said impression cylinder are independently supported relative to said ink collecting cylinder.

8. An intaglio printing press, comprising:

a triple size plate cylinder having three notches formed on a circumferential surface thereof at constant intervals in the circumferential direction, and further including three effective impression areas comprising intaglio plates mounted along a circumferential surface between the three notches thereof;

a quadruple size ink collecting cylinder contacted with said plate cylinder and having four notches formed on a circumferential surface at constant intervals in the circumferential direction, four effective impression areas comprising four blankets mounted between the four notches thereof;

a wiping roller contacted with said plate cylinder;

a triple size impression cylinder having a same triple size diameter as the diameter of said plate cylinder, contacted with said plate cylinder, and having three notches and three effective impression areas located between the notches on the circumferential surface at constant intervals in the circumferential direction;

the respective notches of the impression cylinder, the plate cylinder, and the ink collection cylinder have the same length in the circumferential direction, and the respective effective impression areas of the impression cylinder, the plate cylinder, and the ink collection cylinder have the same length in the circumferential direction; and wherein the ink collection cylinder, the impression cylinder, and the wiping roller are disposed around the plate cylinder at constant intervals in the circumferential direction a plurality of ink supply means, each including an inking device and a roller for supplying inks to said blankets on said ink collecting cylinder, disposed along the circumferential outer surface of said ink collecting cylinder;

a first frame for supporting said plate cylinder, said wiping roller and said impression cylinder;

a second frame for supporting said ink collecting cylinder and said rollers for supplying inks; and a third frame for supporting said plurality of inking devices.

9. An intaglio printing press as claimed in claim 8 wherein said first, second and third frames comprise independent support frames.

10. An intaglio printing press as claimed in claim 8 wherein said second frame includes an operator access window facing said first frame.

11. An intaglio printing press, comprising:

a triple size plate cylinder having three notches formed on a circumferential surface thereof at constant intervals in the circumferential direction, and further having three effective impression areas consisting of intaglio plates mounted along a circumferential surface between the three notches thereof;

a quadruple size ink collecting cylinder contacted with said plate cylinder and having four notches formed on a circumferential surface at constant intervals in the circumferential direction, four effective impression areas consisting of blankets mounted between the four notches thereof, five ink supply means for supplying inks to said blankets disposed along the outer surface of the ink collecting cylinder;

a wiping roller contacted with said plate cylinder; and a triple size impression cylinder having a same size diameter as the diameter of said plate cylinder, and contacted with said plate cylinder, and having three notches and three intermediate effective impression areas formed on the circumferential surface at constant intervals in the circumferential direction;

the respective notches of the impression cylinder, the plate cylinder, and the ink collection cylinder have the same length in the circumferential direction, and the respective effective impression areas of the impression cylinder, the plate cylinder, and the ink collection cylinder have the same length in the circumferential direction; and the ink collection cylinder, the impression cylinder, and the wiping roller are disposed around the plate cylinder at constant intervals in the circumferential direction.

12. An intaglio printing press, comprising:

a triple size plate cylinder having three notches formed on a circumferential surface thereof at constant intervals in the circumferential direction, and further including three intaglio plates forming respective effective impression areas mounted along a circumferential surface between the three notches thereof;

a quadruple size ink collecting cylinder contacted with said plate cylinder and having four notches formed on a circumferential surface at constant intervals in the circumferential direction, four blankets forming respective effective impression areas mounted between the four notches thereof;

a wiping roller contacted with said plate cylinder;

a triple size impression cylinder having a same size diameter as the diameter of said plate cylinder, and contacted with said plate cylinder, and having three notches and respective intermediate effective impression areas formed on the circumferential surface at constant intervals in the circumferential direction;

wherein the ink collecting cylinder, the impression cylinder, and the wiping roller are disposed at regular positions around the circumference of the plate cylinder;

the respective notches of the impression cylinder, the plate cylinder, and the ink collection cylinder have the same length in the circumferential direction, and the respective effective surfaces of the impression cylinder, the plate cylinder, and the ink collection cylinder have the same length in the circumferential direction.

* * * * *